United States Patent [19]

Suematsu et al.

[11] Patent Number: 4,957,856

[45] Date of Patent: Sep. 18, 1990

[54] SILVER HALIDE PHOTOGRAPHIC MATERIAL

[75] Inventors: Koichi Suematsu, Shizuoka; Sumito Yamada, Kanagawa; Shigeru Ohno, Kanagawa; Tadashi Ito, Kanagawa, all of Japan

[73] Assignee: Fuji Photo Film Co., Ltd., Kanagawa, Japan

[21] Appl. No.: 307,704

[22] Filed: Feb. 8, 1989

[30] Foreign Application Priority Data

Feb. 8, 1988 [JP] Japan ..... 63-026978

[51] Int. Cl.[5] ..... G03C 1/84

[52] U.S. Cl. ..... 430/518; 430/522; 430/941

[58] Field of Search ..... 430/518, 522, 213, 941

[56] References Cited

U.S. PATENT DOCUMENTS

| | | | |
|---|---|---|---|
| 3,726,683 | 4/1973 | Yamamoto et al. | 430/522 |
| 4,130,430 | 12/1978 | Sagiyama et al. | 430/522 |
| 4,459,130 | 7/1984 | Helling et al. | 430/941 |

*Primary Examiner*—Richard L. Schilling

*Attorney, Agent, or Firm*—Sughrue, Mion, Zinn, Macpeak & Seas

[57] ABSTRACT

A silver halide photographic material which comprises a support having provided thereon at least one light-sensitive silver halide emulsion layer and at least one subbing layer, wherein the at least one subbing layer comprises a binder, a polymer represented by formula (I), a dye represented by formula (II) and a nonionic surface active agent, all described hereinbelow, which has improved sharpness by virtue of the decoloring capable anti-halation function provided by the subbing layer.

10 Claims, No Drawings

SILVER HALIDE PHOTOGRAPHIC MATERIAL

FIELD OF THE INVENTION

This invention relates to a silver halide photographic material. In particular, this invention relates to a light-sensitive material having a subbing layer having a decoloring capable anti-halation function using a process necessary for improving sharpness, wherein the subbing layer has good surface conditions, good decoloration even under high speed processing, a higher state of fixing rate of the dye to the subbing layer, and a method for coating, not accompanied by increased drying load. More particularly, this invention relates to an X-ray film support for medical use, wherein the support is a transparent polyethylene terephthalate and a subbing layer is provided on both surfaces of the support.

BACKGROUND OF THE INVENTION

Techniques for improving sharpness by adding magenta dyes or yellow dyes to ortho type light-sensitive materials have been developed, as described in U.S. Pat. No. 4,130,429, JP-A-No. 61-116354 and JP-A-No. 61-116349. (the term "JP-A" as used herein refers to an unexamined published Japanese patent application). However, when a dye is simply added to the silver halide emulsion layers, it inevitably has the effect of reducing the photographic sensitivity due to optical absorption. Hence, methods in which these dyes are added to intermediate layers between the silver halide emulsion layers and the support have sometimes been adopted in the industry. But, with the provision of just a simple intermediate layer, the dyes diffuse during the coating of the emulsion layers into these emulsion layers; thus, there is still some loss of photographic sensitivity. Moreover, to make matters even worse, gelatin or some other binder has to be used to coat the intermediate layer; the increase in the amount of binder used inevitably has an adverse effect on the drying properties of the light-sensitive material.

To overcome the above problems, it has been proposed to use basic polymeric mordants to fix water soluble dyes, which dyes can be decolorized during photographic processing in the subbing layer of the support. Such methods have been disclosed in JP-A-No. 62-70830 and JP-A-No. 55-33172. These methods are very effective toward fulfilling objectives of the present invention. However, they fall short because the subbing layer has a coated gelatin weight of not more than 0.5 g/m$^2$, and when a basic polymeric mordant is coated in this gelatin layer, the surface of the subbing layer becomes irregular. That is, stripes, ladder and comet, etc. occur to an intolerable extent. Hence, it is not possible to use the above methods to achieve excellent photographic performance.

A combination of a high molecular weight mordant and a dye having superior characteristics in comparison to prior art techniques was disclosed in JP-A-No. 62-70830; however, the mordant and dye of the present invention improves the fixing percentage and processing time decoloration for the various materials to achieve a material having even more superior effectiveness.

SUMMARY

Accordingly, it is a first object of the present invention to provide a light-sensitive material having improved sharpness.

It is a second object of the present invention to provide a light-sensitive material having a subbing layer having good decoloration capable anti-halation function in the development process.

It is a third object of the present invention to provide a method for effectively coating the subbing layer onto the support.

The above-described objects of the present invention have been achieved by providing a silver halide photographic material which comprises a support, having provided thereon at least one light-sensitive silver halide emulsion layer and at least one subbing layer, wherein the subbing layer comprises:

(a) a binder;

(b) a polymer represented by formula (I):

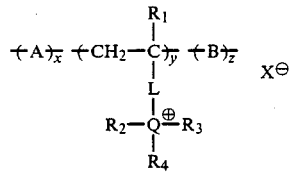

(I)

wherein A represents an ethylenic unsaturated monomer unit; $R_1$ represents a hydrogen atom or a lower alkyl group having from 1 to 6 carbon atoms; L represents a divalent group having from 1 to 12 carbon atoms; $R_2$, $R_3$ and $R_4$, which may be the same or different, each represents an alkyl group, an aralkyl group or a hydrogen atom; Q represents nitrogen or phosphorus, provided that $R_2$, $R_3$ and $R_4$ may be linked together to form, together with Q, a cyclic structure; Xe represents an anion other than iodine ion; B represents a structural unit in which copolymerizable monomers having at least two ethylenic unsaturated groups have been copolymerized; x is selected to constitute from 0 to 90 mol %; y is selected to constitute from 10 to 100 mol %; and z is selected to constitute from 0 to 90 mol %;

(c) a dye represented by formula (II):

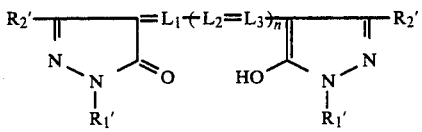

(II)

wherein $R_1'$ represents an aryl, alkyl, aralkyl, or heterocyclic group substituted with at least one carboxylic acid or sulfonic acid group, $R_2'$ represents a group —$CONR_3'R_4'$ or a group —$NR_3'COR_4'$ wherein $R_3'$ represents a hydrogen atom or an alkyl group, and $R_4$ ≡represents an alkyl group having a hydrophobic substituent constant x within a range from 1.60 to 3.9, $L_1$ $L_2$, and $L_3$ each represents a methine group, and n represents 0, 1 or 2; and (d) a nonionic surface active agent.

DETAILED DESCRIPTION OF THE INVENTION

The subbing layer as used herein represents a layer which is positioned between a support and an emulsion layer and which is adjacent to the support.

The binder contained in the subbing layer preferably is gelatin.

The polymer represented by formula (I) is now explained in detail.

Examples of the ethylenic unsaturated monomer represented by A include olefins (for example, ethylene, propylene, 1-butene, vinyl chloride, vinylidene chloride, isobutene, vinyl bromide, etc.), dienes (for example, butadiene, isoprene, chloroprene, etc.), ethylenic unsaturated esters of fatty acids or aromatic carboxylic acids (for example, vinyl acetate, allyl acetate, vinyl propionate, vinyl butyrate, vinyl benzoate, etc.), esters of ethylenic unsaturated acids (for example, methyl methacrylate, butyl methacrylate, tert-butyl methacrylate, cyclohexyl methacrylate, benzyl methacrylate, phenyl methacrylate, octyl methacrylate, amyl acrylate, 2-ethylhexyl acrylate, benzyl acrylate, maleic acid dibutyl ester, fumaric acid diethyl ester, ethyl crotonate, methylene malonic acid dibutyl ester, etc.), styrenes (for example, styrene, o-methylstyrene, vinyltoluene, chloromethyl styrene, chlorostyrene, dichlorostyrene, bromostyrene, etc.), and unsaturated nitriles (for example, acrylonitrile, methacrylonitrile, allylcyanide, crotononitrile, etc.). Among these compounds, the use of the styrenes and/or the methacrylic acid esters is especially desirable in view of (i) their emulsion polymerization properties and (ii) their hydrophobic nature. Two or more types of the above-mentioned monomers may be used in combination as the monomer unit represented by A of formula (I).

$R_1$ preferably represents a hydrogen atom or a methyl group from the point of view of the polymer reaction properties.

The preferred L groups are the divalent groups represented by

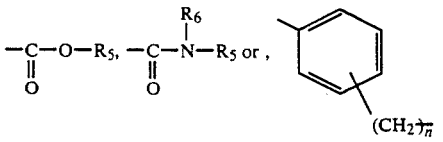

wherein $R_5$ represents an alkylene group (for example, a methylene group, ethylene group, trimethylene group, tetramethylene group, etc.), an arylene group or an aralkylene group (for example, a

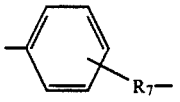

group, wherein R; represents an alkylene group which has from 1 to 6 carbon atoms); $R_6$ represents an alkyl group which has from 1 to 20 carbon atoms, an aralkyl group which has from 7 to 20 carbon atoms or a hydrogen atom; and n is 1 or 2.

Among these,

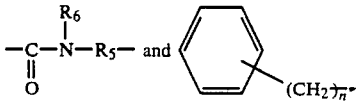

are preferred from the point of view of alkali resistance. The group

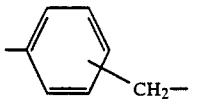

is more preferred from the viewpoint of emulsion polymerization properties, etc.

Q in formula (I) is preferably a nitrogen atom, from the viewpoint of the reduced toxicity of the raw material.

$X^{\ominus}$ in formula (I), which is an anion other than iodine ion, is preferably a halogen ion (such as a chlorine ion, bromine ion, etc.), an alkylsulfate ion (such as a methylsulfate ion, ethylsulfate ion, etc.), an alkyl or arylsulfonic acid ion (such as a methanesulfonate ion, ethanesulfonate ion, benzene-sulfonate ion, p-toluenesulfonate ion, etc.), a nitrate ion, an acetate ion, or a sulfate ion, etc. Among these, a chlorine ion, an alkylsulfate ion, an arylsulfonate ion and a sulfate ion are especially preferred.

Preferably, $R_2$, $R_3$ and $R_4$ each independently represents an alkyl group which has from 1 to 20 carbon atoms, an aralkyl group which has from 7 to 20 carbon atoms or a hydrogen atom. It is more preferable that only one of $R_2$, $R_3$ and $R_4$ is a hydrogen atom.

The alkyl groups and aralkyl groups represented by $R_2$, $R_3$ and $R_4$ include substituted alkyl groups and substituted aralkyl groups.

The unsubstituted alkyl group may be, for example, a methyl group, an ethyl group, a propyl group, an isopropyl group, a t-butyl group, a hexyl group, a cyclohexyl group, a 2-ethylhexyl group, a dodecyl group etc. The substituted alkyl group may be, for example, an alkoxyalkyl group (such as methoxymethyl group, methoxybutyl group, ethoxyethyl group, butoxyethyl group, vinyloxyethyl group, etc.), a cyanoalkyl group (such as 2-cyanoethyl group, 3-cyanopropyl group, etc.), a haloalkyl group (such as 2-fluoroethyl group, 2-chloroethyl group, perfluoropropyl group, etc.), an alkoxycarbonylalkyl group (such as ethoxycarbonylmethyl group, etc.), an allyl group, a 2-butenyl group, a propargyl group, etc.

The unsubstituted aralkyl group may be, for example, a benzyl group, a phenethyl group, a diphenylmethyl group, a naphthylmethyl group, etc. The substituted aralkyl group may be, for example, an alkylaralkyl group (such as 4-methylbenzyl group, 2,5-dimethylbenzyl group, 4-isopropylbenzyl group, 4-octylbenzyl group, etc.), an alkoxyaralkyl group (such as 4-methoxybenzyl group, 4-pentafluoropropenyloxybenzyl group, 4-ethoxybenzyl group, etc.), a cyanoaralkyl group (such as 4-cyanobenzyl group, 4-(4-cyanophenyl)benzyl group, etc.), or a haloaralkyl group (such as 4-chlorobenzyl group, 3-chlorobenzyl group, 4-bromobenzyl group, 4-(4-chlorophenyl)benzyl group, etc.).

The alkyl groups represented by $R_2$, $R_3$,$R_4$ in formula (I) more preferably have from 1 to 12 carbon atoms and the aralkyl groups more preferably have from 7 to 14 carbon atoms.

In formula (I), $R_2$, $R_3$ and $R_4$ may be linked together to form, together with Q, a cyclic structure such as a morpholine ring, a piperidine ring, a pyrrolidine ring and a pyridine ring.

In formula (I), x preferably is from about 1 to 60 mol %, more preferably about 3 to 30 mol %, y preferably is from about 20 to 99.9 mol %, more preferably about 30 to 95 mol %, and z preferably is from about 0 to 60 mol %, more preferably about 0 to 50 mol %.

B represents a structural unit in which copolymerizable monomers each having at least two ethylenic unsaturated groups have been copolymerized. Examples of B include ethyleneglycol dimethacrylate, diethyleneglycol dimethacrylate, neopentylglycol dimethacrylate, tetramethyleneglycol dimethacrylate, pentaerythritol tetramethacrylate, trimethylolpropane trimethacrylate, ethyleneglycol diacrylate, diethyleneglycol diacrylate, neopentylglycol diacrylate, tetramethyleneglycol diacrylate, trimethylolpropane triacrylate, allyl methacrylate, allyl acrylate, diallyl phthalate, methylenebisacrylamide, methylenebismethacrylamide, trivinylcyclohexane, divinylbenzene, N,N-bis(vinylbenzyl)-N,N-dimethylammonium chloride, N,N-diethyl-N-(methacryloyloxyethyl)-N-(vinylbenzyl)ammonium chloride, N,N,N',N'-tetraethyl-N,N'-bis(vinylbenzyl)-pxylylenediammonium dichloride, N,N'-bis(vinylbenzyl}triethylenediammonium dichloride, N,N,N',N'-tetrabutyl-N,N'-bis(vinylbenzyl)ethylenediammonium dichloride, etc. Among these compounds, the use of divinylbenzene and trivinylcyclohexane is especially preferred from the viewpoint of hydrophobic properties and alkali resistance.

The following compounds are illustrative of formula (I), but the present invention is not to be construed as being limited thereto. In the following compounds, ratios of x, y and z are represented by mol.

(I-1)

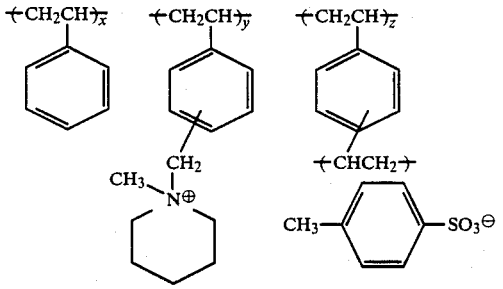

x:y:z = 47.5:47.5:5

(I-2)

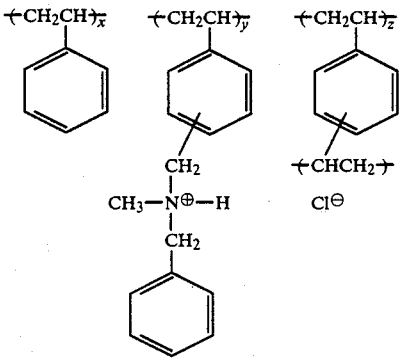

-continued x:y:z = 45:45:10

(I-3)

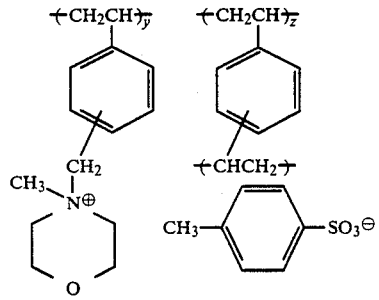

y:z = 95:5

(I-4)

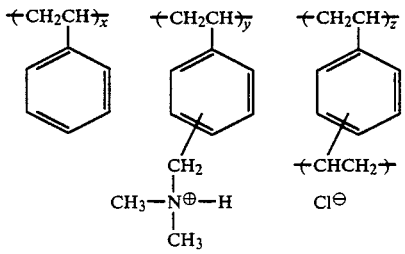

x:y:z = 45:45:10

(I-5)

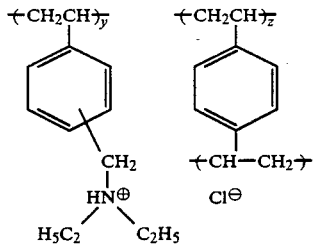

y:z = 80:20

(I-6)

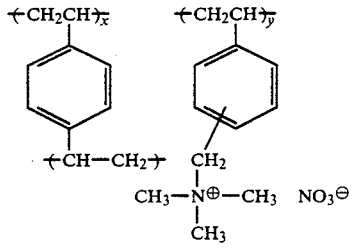

x:y = 50:50

It is preferred that these polymer are used in the form of a polymer latex as disclosed in U.S. Pat. No. 4,312,940.

The particle size of the polymer latex is preferably from about 0.03 μm to 1.0 μm, more preferably from about 0.03 μm to 0.5 μm.

The amount of the polymer represented by formula (I) added is from about 5 to 300 mg/m$^2$, and preferably from about 10 to 100 mg/m$^2$, in a single subbing layer.

The dye represented by formula (II) is now explained in detail.

In formula (II), $R_1'$ represents an aryl, alkyl, aralkyl, or heterocyclic group having at least one carboxylic acid or sulfonic acid group, $R_2'$ represents —$CONR_3'R_4'$ or —$NR_3'COR_4'$ (wherein $R_3'$ represents a hydrogen atom or an alkyl group and $R_4'$ represents an alkyl group having a hydrophobic substitutent constant $\pi$ within a range of from 1.60 to 3.9), $L_1$ $L_2$, and $L_3$ each represent methine groups, and n represents 0, 1, or 2.

Specific examples of the groups represented in formula (II) are shown below.

The carboxylic acid group or sulfonic acid group in the aryl, alkyl, aralkyl, or heterocyclic group represented by $R_1'$ can be bonded directly to the aryl, alkyl, aralkyl or heterocyclic group or can be bonded thereto via a divalent linking group (for example, an alkyleneoxy group (e.g., 2-carboxyethoxy, 3-sulfopropoxy, 4-sulfobutoxy), an alkyleneacylamino group (e.g., 8-carboxypropionylamino)phenylene group (e.g., o-sulfophenyl, p-carboxyphenyl)), an alkyleneaminocarbonyl group (e.g., 2-sulfoethylaminocarbonyl), and an alkylenesulfonyl group (e.g., 3-sulfopropylsulfonyl), etc.).

The aryl, alkyl, aralkyl, or heterocyclic groups can also have substituted groups other than carboxylic acid and sulfonic acid [for example, halogen atoms (e.g., chlorine, bromine, iodine), aryl groups (e.g., phenyl, naphthyl), hydrogen groups, alkyl groups having from 1 to 4 carbons (e.g., methyl, ethyl, propyl, butyl, isopropyl), alkoxy groups having 1 to 6 carbon atoms (e.g., methoxy, ethoxy, 2-hydroxyethoxy, 2-methoxyethoxy), aryloxy groups (e.g., phenoxy), amino groups (e.g., dimethylamino, diethylamino), acylamino groups (e.g., acetylamino), cyano groups, nitro groups, etc.].

The aryl, alkyl and aralkyl groups generally have 1 to 16 carbon atoms.

It is preferred that the alkyl group represented by $R_1'$ be an alkyl group having at least one carboxylic acid or sulfonic acid group, which has 1 to 6 carbon atoms (e.g., sulfomethyl, carboxymethyl, 2-sulfoethyl, 2-carboxyethyl, 3-sulfopropyl, 3-sulfo-2-methylpropyl, 3-sulfo-2,2'-dimethylpropyl, 4-sulfobutyl, 4-carboxybutyl, 5-sulfopentyl, 6-sulfohexyl, 5-carboxypentyl, and 6-carboxyhexyl).

It is preferred that the aralkyl group represented by $R_1'$ be an aralkyl group having at least one carboxylic acid or sulfonic acid group, which has 7 to 15 carbon atoms [e.g., 4-sulfobenzyl, 2-sulfobenzyl, benzyl, 4-sulfophenethyl, 4-carboxybenzyl, 2,4-di(3-sulfopropyloxy)benzyl, and 2-hydroxy-4-(2-sulfoethoxy)benzyl].

It is preferred that the aryl group represented by $R_1'$ be an phenyl group having at least one carboxylic acid or sulfonic acid group [e.g., 4-sulfophenyl, 4-carboxy phenyl, 2-methyl-4-sulfophenyl, 3-sulfophenyl, 2,4-disulfophenyl, 3,5-disulfophenyl, 2-chloro-4-sulfophenyl, 2-methoxy-4-sulfophenyl, 4-chloro-3-sulfophenyl, 2,5-dichloro-4-sulfophenyl, 4-phenoxy-3sulfophenyl, 2-methoxy-5-sulfophenyl, 2-hydroxy-4-sulfophenyl, 2,5-dichloro-4-sulfophenyl, 4-phenoxy-3-sulfophenyl, 4-(3-sulfopropyloxy)phenyl, 4-(N-methyl-N-sulfoethylamino)phenyl, 3-carboxy-2-hydroxy-5-sulfophenyl, and 2,6-diethyl-4-sulfophenyl] or a naphthyl group (e.g., 3,6-disulfo-o-naphthyl, 8-hydroxy-3,6-disulfo-α-naphthyl, 5-hydroxy-7-sulfo-β-naphthyl, and 6,8-disulfo-β-naphthyl).

It is preferred that the heterocyclic group represented $R_1'$ be a 5- or 6-membered heterocyclic group having at least one nitrogen atom (e.g., 5-sulfo pyridine-2-yl, 5-carboxypyridine-2-yl, 6-sulfoquinoline-2-yl, 6-sulfoquinoline-4-yl, 5-sulfobenzothiazol-2-yl, 5-carboxybenzothiazol-2-yl, 6-sulfobenzoxazol-2-yl, 6-carboxybenzoxazol-2-yl, 6-sulfomethyl pyridine-2-yl, 5-sulfopyrimidine-2-yl.

$R_3'$ represents a hydrogen atom or an alkyl group. An alkyl group having 1 to 3 carbon atoms (e.g., methyl, ethyl, n-propyl, isopropyl) is preferred. It is preferred that $R_3'$ represents a hydrogen atom.

$R_4'$ represents an alkyl group having a hydrophobic substituent constant $\pi$ within a range of from about 1.60 to 3.9. If $\pi$ is within the range from about 1.60 to 3.9, $R_4'$ can have a substituent (for example, hydroxy group, carboxylic acid group, a fluorine atom, a chlorine atom, a bromine atom, a cyano group, an alkoxy group (e.g., methoxy, ethoxy), an amino group (e.g., dimethylamino, diethylamino), an amide group (e.g., acetylamino, methanesulfonamide), a carbamoyl group (e.g., methylcarbamoyl, ethylcarbamoyl), and a sulfamoyl group (e.g., methylsulfamoyl, ethylsulfamoyl)).

The constant values for the hydrophobic substituents are described in C. Hansch, A. Leo, Substituent Constants for Correlation Analysis in Chemistry and Biology, John Wiley & Sons, Inc., (1979) pages 65–167, and the values for those substituents not listed therein can be determined using the calculation method described in C. Hansch et al. *Journal of Medicinal Chemistry*, Vol. 20 pages 304–306 (1977). For example, a hydrophobic substituent constant for a substituent X, $\pi_x$ can be determined by subtracting the benzene distribution coefficient log $P_{c6H6}$ (wherein log $P_{c6H6}=2.13$) from the distribution coefficient log $P_{X\text{-}C6H5}$ of a benzene derivative ($X\text{-}C_6H_5$) having substituent X. Log $P_{X\text{-}C6H5}$ can also be determined using the method in the above mentioned *Substituent Constants for Correlation Analysis in Chemistry and Biology*, pages 18–37.

It is particularly desirable that $R_3'$ in formula (II) represents a hydrogen atom, and that $R_4'$ represents an unsubstituted alkyl group having from 4 to 6 carbon atoms (e.g., n-butyl, n-pentyl, n-hexyl, isobutyl, secbutyl, tert-butyl, 1-ethylpropyl, 1-methylbutyl, 2-methylbutyl, 3-methylbutyl, 1,1-dimethylpropyl, 2,2-dimethylpropyl), or a 4-chlorobutyl group, a 7-hydroxyheptyl group, a 6-carboxyhexyl group, a 8-hydroxyoctyl group, a 2-ethylbutyl group, or a 5-cyanopentyl group.

The methine group represented by $L_1$, $L_2$, and $L_3$ can have a substituent (e.g., methyl, ethyl, 2-sulfoethyl, cyano, oxygen atoms, etc.).

The carboxylic acid or the sulfonic acid group in formula (II) can be a free acid or a salt thereof (e.g., Na, K, $(C_2H_5)_3NH$, pyridinium, ammonium salts, etc.).

It is particularly desirable in formula (II) that $R_1'$ represents an alkyl having from 1 to 4 carbon atoms, benzyl, phenethyl, or phenyl group having at least one sulfonic acid group.

The following are specific examples of the dyes represented by formula (II); however, this invention is not limited to these examples.

| Dye | $R_1$ | $R_2$ | $=L_1-(L_2=L_3)_n-$ |
|---|---|---|---|
| II-1 | 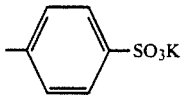 | $-NHCOC_4H_{9(n)}$ | $=CH-$ |

-continued

| Dye | $R_1$ | $R_2$ | $=L_1-(L_2=L_3)_n$ |
|---|---|---|---|
| II-2 | 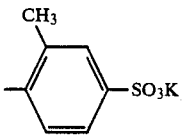 | $-NHCOC_4H_{9(iso)}$ | $=CH-$ |
| II-3 | 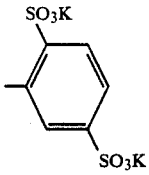 | $-NHCOC_6H_{13(n)}$ | $=CH-$ |
| II-4 | 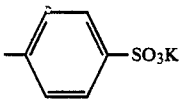 | $-NHCOC_5H_{11(iso)}$ | $=CH-$ |
| II-5 | $-(CH_2)_4SO_3K$ | $-NHCOC_4H_{9(n)}$ | $=CH-$ |
| II-6 | $-(CH_2)_2SO_3K$ | $-CONHC_4H_{9(n)}$ | $=CH-$ |
| II-7 | 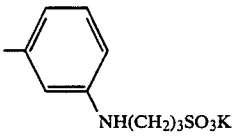 | $-CONHC_4H_{9(iso)}$ | $=CH-$ |
| II-8 | 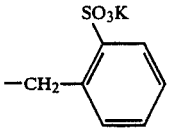 | $-CONHC_4H_{9(n)}$ | $=CH-CH=CH-$ |
| II-9 | $-(CH_2)_3SO_3K$ | $-CONHC_5H_{11(iso)}$ | $=CH-CH=CH-$ |
| II-10 | 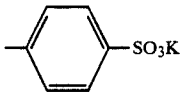 | $-CONHC_4H_{9(n)}$ | $=CH-CH=CH-$ |
| II-11 | 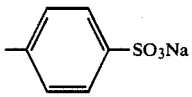 | $-CONHC_4H_{9(sec)}$ | $=CH-$ |
| II-12 | 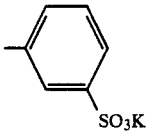 | $-NHCO(CH_2)_7OH$ | $=CH-$ |
| II-13 | 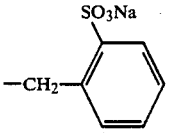 | $-NHCOC_4H_{9(n)}$ | $=CH-$ |
| II-14 | $-(CH_2)_3SO_3K$ | $-NHCOC_4H_{9(tert)}$ | $=CH-$ |
| II-15 | 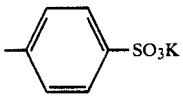 | $-NHCOC_4H_{9(iso)}$ | $=CH-CH=CH-$ |

-continued

| Dye | $R_1$ | $R_2$ | $=L_1-(L_2=L_3)_n-$ |
|---|---|---|---|
| II-16 | 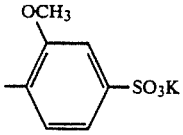 | $-NHCOC_4H_{9(n)}$ | $=CH-CH=CH-$ |
| II-17 | 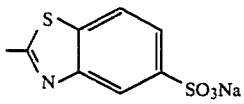 | $-CONHC_4H_{9(n)}$ | $=CH-CH=CH-$ |
| II-18 | 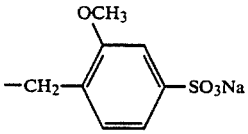 | $-CONHC_4H_{9(sec)}$ | $=CH-(CH=CH)_2-$ |
| II-19 | $-(CH_2)_2SO_3K$ | $-CONHC_6H_{13(n)}$ | $=CH-CH=CH-$ |
| II-20 | $-CH_2CH_2COOH$ | $-NHCOC_4H_{9(sec)}$ | $=CH-(CH=CH)_2-$ |
| II-21 | $-(CH_2)_2SO_3K$ | $-CON(CH_3)C_4H_{9(n)}$ | $=CH-CH=CH-$ |
| II-22 | 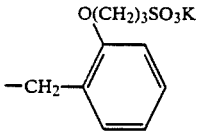 | $-CONHC_5H_{11(n)}$ | $=CH-CH=CH-$ |
| II-23 | 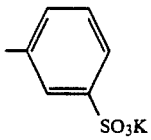 | $-CONHC_4H_{9(iso)}$ | $=CH-CH=CH-$ |
| II-24 | 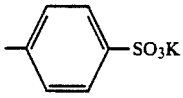 | $-CONHC_6H_{13(n)}$ | $=CH-(CH=CH)_2-$ |
| II-25 | 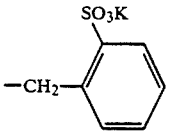 | $-CONHC_4H_{9(iso)}$ | $=CH-CH=CH-$ |
| II-26 | 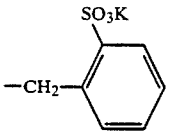 | $-CONHC_4H_{9(sec)}$ | $=CH-CH=CH-$ |
| II-27 | $-(CH_2)_4SO_3K$ | $-CONH(CH_2)_7OH$ | $=CH-CH=CH-$ |
| II-28 | $-(CH_2)_3SO_3K$ | $-CONHC_4H_{9(iso)}$ | $=CH-(CH=CH)_2-$ |
| II-29 | 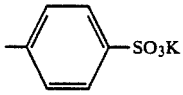 | $-NHCOC_5H_{11(n)}$ | $=CH-(CH=CH)_2-$ |
| II-30 | 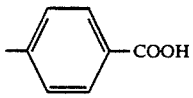 | $-NHCOC_4H_{9(iso)}$ | $=CH-(CH=CH)_2-$ |
| II-31 | 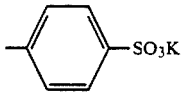 | $-NHCOC_6H_{13(n)}$ | $=CH-(CH=CH)_2-$ |

-continued

| Dye | $R_1$ | $R_2$ | $=L_1-(L_2=L_3)_n$ |
|---|---|---|---|
| II-32 | 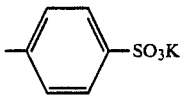 | $-CONHC_4H_{9(n)}$ | $=CH-$ |
| II-33 | 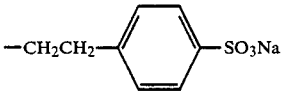 | $-CONHC_4H_{9(n)}$ | $=CH-CH=CH-$ |
| II-34 | $-(CH_2)_2SO_3K$ | $-CONHC_4H_{9(iso)}$ | $=CH-(CH=CH)_2$ |
| II-35 | $-(CH_2)_2SO_3K$ | $-NHCOC_4H_{9(n)}$ | $=CH-(CH=CH)_2$ |
| II-36 | $-(CH_2)_4SO_3K$ | $-NCH_3COC_4H_{9(iso)}$ | $=CH-(CH=CH)_2$ |
| II-37 | 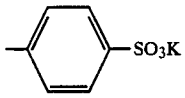 | $-NHCOC_4H_{9(n)}$ | $=CH-C(CH_3)=CH-$ |
| II-38 | 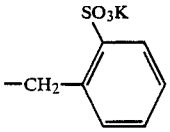 | $-CONHC_4H_{9(n)}$ | $=C(CH_3)-CH=CH-$ |
| II-39 | 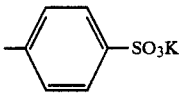 | $-CONHC_5H_{11(n)}$ | $=CH-CH=C(CH_3)-CH=CH-$ |
| II-40 | 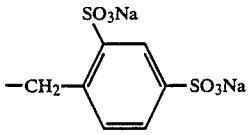 | $-CONHC_5H_{11(n)}$ | $=CH-CH=CH-$ |
| II-41 | 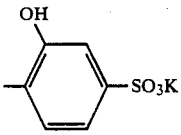 | $-CONHC_5H_{11(n)}$ | $=CH-CH=CH-$ |
| II-42 | 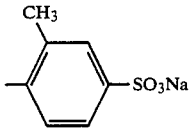 | $-CONH(CH_2)_7OH$ | $=CH-(CH=CH)_2$ |
| II-43 | 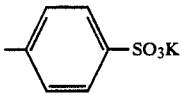 | $-CONHC_4H_{9(n)}$ | $=CH-(CH=CH)_2$ |
| II-44 | 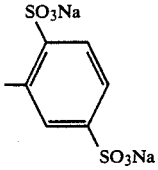 | $-CONHC_5H_{11(n)}$ | $=CH-(CH=CH)_2$ |
| II-45 | 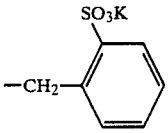 | $-NHCOC_4H_{9(iso)}$ | $=CH-CH=CH-$ |

It is preferred that the amount of dye represented by formula (II) used is from 0.5 to 200 mg/m$^2$, the range from 2 to 50 mg/m$^2$ being particularly preferred.

The nonionic surfactant used in the present invention serves the role of keeping a subbing layer surface which includes the polymer represented by formula (I) uniformly. Compounds well known to this industry can be used as the nonionic surfactant.

Actual examples of nonionic surfactants which are preferably used in the present invention are indicated below, but the present invention is not to be construed as being limited thereto.

$C_{11}H_{23}COO(CH_2CH_2O)_8H$ III-1

$C_{15}H_{31}COO(CH_2CH_2O)_{15}H$ III-2

$C_{17}H_{33}COO(CH_2CH_2O)_5(CH_2-CH(OH)-CH_2)_3(CH_2CH_2O)_5H$ III-3

$C_8H_{17}O(CH_2CH_2O)_2H$ III-4

$C_{12}H_{25}O(CH_2CH_2O)_{10}H$ III-5

$C_{16}H_{33}O(CH_2CH_2O)_{12}H$ III-6

$C_{18}H_{35}O(CH_2CH(OH)CH_2O)_2(CH_2CH_2O)_{10}H$ III-7

$C_{22}H_{45}O(CH_2CH_2O)_{25}H$ III-8

III-9

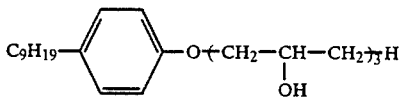

III-10

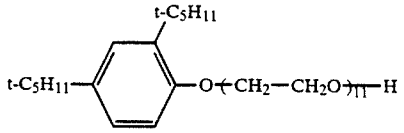

III-11

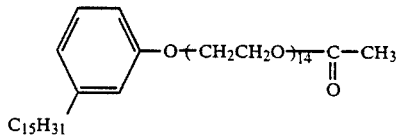

$C_{16}H_{33}O(CH_2CH_2O)_4(CH_2CH(OH)CH_2)_2(CH_2CH_2O)_4H$ III-12

III-13

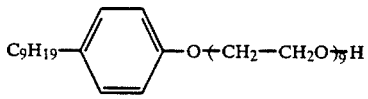

III-14

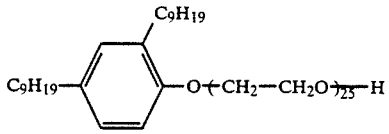

III-15

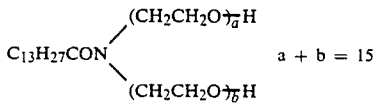

-continued

III-16

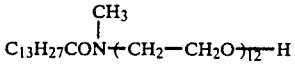

III-17

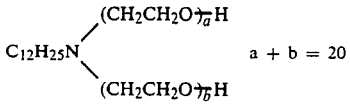

III-18

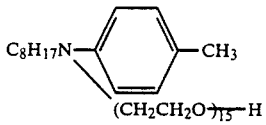

$C_{12}H_{25}S(CH_2CH_2O)_{16}H$ III-19

$C_{12}H_{25}O(CHCH_2O)_3(CH_2CH_2O)_{15}H$ (CH$_3$ on the CHCH$_2$O unit) III-20

III-21

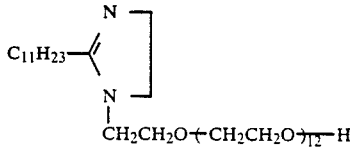

III-22

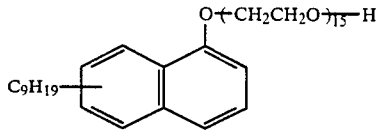

III-23

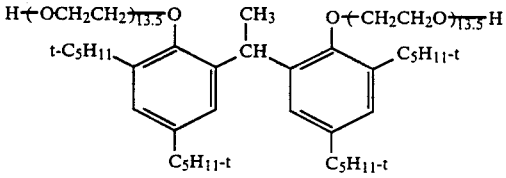

III-24

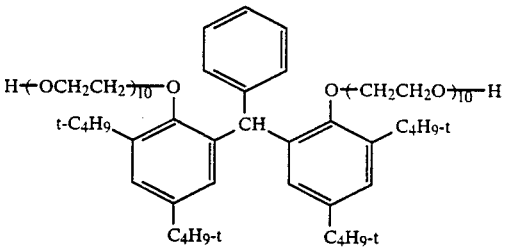

III-25

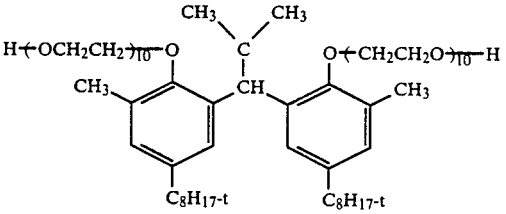

Among these nonionic surfactants, the compounds represented by the formulae (A) and (B) below are preferred because they have a good surface improving effect.

Those compounds represented by general formula (A), according to JP-A-62-231253, are known to have an adhesion improving effect:

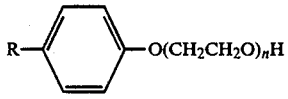

(A)

$R-O(CH_2CH_2O)_nH$ (B)

wherein R represents a substituted or unsubstituted alkyl group having from 1 to 30 carbon atoms, preferably from 3 to 22 carbon atoms; and n has a value of at least 5 but not more than 50, and preferably of at least 7 but not more than 40.

The substituents for the substituted alkyl group of R include a halogen group and a hydroxy group.

Compounds of formulae (A) and (B) which are useful in the invention are indicated below, but the present invention is not to be construed as being limited thereto.

III-26

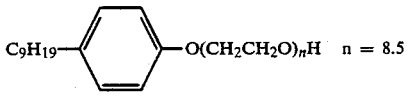

$C_9H_{19}-O(CH_2CH_2O)_nH$ n = 8.5

III-27

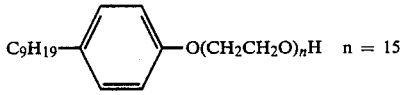

$C_9H_{19}-O(CH_2CH_2O)_nH$ n = 15

III-28

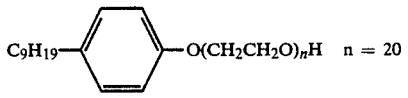

$C_9H_{19}-O(CH_2CH_2O)_nH$ n = 20

III-29

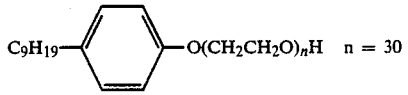

$C_9H_{19}-O(CH_2CH_2O)_nH$ n = 30

III-30

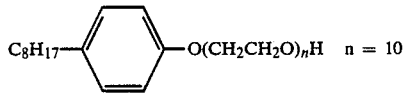

$C_8H_{17}-O(CH_2CH_2O)_nH$ n = 10

| | | |
|---|---|---|
| $C_{12}H_{25}O(CH_2CH_2O)_nH$ | n = 10 | III-31 |
| $C_{12}H_{25}O(CH_2CH_2O)_nH$ | n = 15 | III-32 |
| $C_8H_{17}O(CH_2CH_2O)_nH$ | n = 10 | III-33 |
| $C_8H_{17}O(CH_2CH_2O)_nH$ | n = 18 | III-34 |

It is preferred that the amount of these nonionic surfactants added is from about 0.05 g/liter to 5g/liter of the coating liquid constituting the subbing layer, with about 0.2 g/liter to 2 g/liter being preferred.

It is preferred that the coating amount of these nonionic surfactants be from 1 to 200 mg/m$^2$, with 3 to 50 mg/m$^2$ being preferred and 5 to 30 mg/m$^2$ of the subbing layer being particularly preferred.

The methods which can be used for coating the subbing layer include the so-called lamination method in which a layer which is well bonded to the support is provided as a first subbing layer, and a hydrophilic resin is coated over this layer as a second subbing layer as disclosed in JP-A-52-49019, JP-A-52-42114 and JP-A-52-104913. Also included is the method in which just a single resin layer which contains both hydrophobic groups and hydrophilic groups is coated as disclosed in JP-B-47-24270 (the term "JP-B" as used herein refers to an examined Japanese patent publication) and JP-A-51-30274. Either of these methods can be effectively employed in this invention but the lamination method has a more desirable effect.

When the lamination method is applied to the present invention, it is particularly desirable that the second subbing layer include the polymer represented by formula (I), the dye represented by formula (II) and the nonionic surfactant of the present invention.

In this case, it is preferred that the thickness of the first subbing layer is about 0.05 to 1.0 μm, particularly about 0.1 to 0.5 μm, and the layer thickness of the second subbing layer is about 0.05 to 0.3 μm, particularly about 0.08 to 0.2 μm.

The first and second subbing layers can both be dried at a temperature of 80° C. to 200° C. after coating to increase the adhesion between the support and the photographic layer (for example, a silver halide emulsion layer).

It is preferred in the present invention that the first subbing layer contains a butadiene type polymer latex (for example, a styrene-butadiene copolymer latex) or a vinylidene chloride type polymer, that the second subbing layer contains a latex form of a polymer of formula (I), a dye of formula (II) and a nonionic surfactant.

Moreover, surface treatment of the support prior to coating the subbing layer, as disclosed in JP-A-52-114670, also has a beneficial effect in this invention. Known methods of surface treatment which can be used include chemical treatments, mechanical treatments, coronal discharge treatments, flame treatments, treatment with ultraviolet radiation, high frequency treatments, glow discharge treatments, active plasma treatments, laser treatments, mixed acid treatments, ozone oxidation treatments, etc.

Further improvement in the surface condition of the subbing layer can be achieved by using a betaine surfactant (for example, $C_{11}H_{23}CONHCH_2CH_2CHN^+(CH_3)_2COO^-$, etc.) conjointly with a nonionic surfactant in a subbing layer of this invention. In this case, the amount of the betaine surfactant in the subbing layer is preferably about 1 to 50 mg/m$^2$, more preferably about 1 to 20 mg/m$^2$.

Moreover, a method in which a water soluble methylcellulose is included in the subbing layer, as disclosed in JP-A-60-26944, is especially useful in this invention. The methylcellulose may be included in an amount of from about 1 wt% to 99 wt%, preferably at a rate of from about 2 wt% to 50 wt%, and most preferably at a rate of from about 3 wt% to 30 wt%, with respect to the weight of binder, i.e., gelatin, in the subbing layer.

The use of methylcellulose having a degree of substitution of from about 0 to 2.5, preferably from about 0.5 to 2.5, and most preferably from about 1.0 to 2.5, has an excellent effect. The degree of polymerization of the methylcellulose can be varied with respect to the relationship between the viscosity and the method of coating, and preferably ranges from 100 to 100,000.

Any of the known methods of black and white photographic processing and the known processing baths as disclosed, for example, in *Research Disclosure* No. 176, RD-17643, pages 38 to 39 (December, 1978) can be used for the photographic processing of the light-sensitive materials of this invention. A processing temperature of from 18° C. to 50° C is normally selected, but temperatures below 18° C. and temperatures in excess of 50° C. can also be used. However, the use of rapid processing in automatic developing machines at temperatures of from 30° C. to 45° C. is especially desirable in this invention.

In the case of light-sensitive materials for medical photography purposes, a dry to dry processing time of from about 30 to 120 seconds, preferably of from about 30 to 90 seconds, is desirable. In the case of a dry to dry time of from about 30 to 60 seconds, the present invention can provide excellent effects.

The known developing agents can be included in the development bath and the subbing layer which are used for black and white photographic processing. Thus, dihydroxybenzenes (for example, hydroquinone), 3-pyrazolidones (for example, 1-phenyl-3-pyrazolidone), aminophenols (for example, N-methyl-p-aminophenol) etc. can be used either individually or in combination. In general, other known additives such as preservatives, alkalis, pH buffers, anti-foggants, etc. are included in the development bath. Solution promotors, toning agents, development accelerators (for example, quaternary salts, hydrazine, benzyl alcohol), surfactants, defoaming agents, hard water softening agents, film hardening agents (for example, glutaraldehyde) and viscosity imparting agents etc. can also be included, as required, in the development bath.

The methods in which a developing agent is included in the light-sensitive material, for example, in the emulsion layer, and in which the light-sensitive material is developed by treatment in an aqueous alkali solution can be used as a special form of development processing. The developing agents which are hydrophobic can be included in an emulsion layer using the various methods which have been described in *Research Disclosure* No. 169, RD-16928 (May, 1978), U.S. Pat. No. 2,739,890, British Patent No. 813,253 or West German Patent No. 1,547,763, etc. Development processing of this type can be combined with a silver salt stabilization treatment using thiocyanate as described in T. H. James, *The Theory of the Photqr. Proc.*, 4th Edition (1977), page 438.

The compositions in general use as fixing baths (e.g., 22 Fixer of Eastman Kodak Company) can be employed in the present invention for that purpose. The organic sulfur compounds which are known to be effective as fixing agents as well as thiosulfates and thiocyanates can be used as the fixing agent. Water soluble aluminum salts can also be included in the fixing bath as film hardening agents. The fixing process time is not more than 15 seconds, preferably not more than 10 seconds and most preferably not more than 7 seconds.

Silver chloride, silver chlorobromide, silver bromide, silver iodobromide and silver chloroiodobromide can be used for the light-sensitive silver halide emulsion which is used together with a subbing layer of the present invention. The use of silver bromide or silver iodobromide is preferred from the viewpoint of high sensitivity. In particular, the silver halide emulsion having an iodide content of from 0 to 3.5 mol % is preferably used in the present invention.

The use of silver iodobromide grains which have a structure in which the interior consists of a high iodide content phase is especially preferable.

Furthermore, compounds which release an inhibitor during development, as disclosed in JP-A-61-230135 and JP-A-63-25653, can additionally be used in the present invention.

The use of tabular grains for the silver halide grains which are used in the invention is especially effective.

Tabular silver halide grains can be manufactured using a suitable combination of the methods known in the industry. For example, tabular silver halide emulsions have been described by Cugnac and Chateau in *Evolution of the Morphology of the Silver Bromide Crystals during Physical Ripening,* Science et Industrie Photographie, Vol. 33, No. 2 (1962), pages 121 to 125; Duffin, *Photographic Eulsion Chemistry,* Focal Press, New York, 1966, pages 66 to 72; and A. P. H. Trivelli and W. F. Smith, *Photographic Journal,* Vol. 80, page 285 (1940) etc. In addition, tabular silver halide emulsions can be prepared easily with reference to the methods disclosed in JP-A-58-127921, JP-A-58-113927, JP-A-58-113928 and in U.S. Pat. No. 4,439,520, etc. The tabular grain emulsions preferably used in this invention are those which have an average aspect ratio as defined in column 12 of U.S. Patent 4,439,520 of at least 3, and preferably of from 4 to 8.

The present invention is illustrated in practical terms below by means of examples, but is not to be construed as being limited thereto. Unless otherwise indicated, all ratios, percents, parts, etc., are by weight.

EXAMPLE 1

A first coating liquid of which the composition is indicated below was coated using a wire bar coater at the rate of 5.1 cc/m$^2$ on a biaxially extended polyethyleneterephthalate film support which had a thickness of 175 μm and had been subjected to a coronal discharge treatment. Then, the coating was dried for 1 minute at 175° C. A first subbing layer was then established on the other side of the film in the same way.

| | |
|---|---|
| Butadiene/styrene copolymer latex solution* (solid fraction 40%, average particle size 0.15 μm, butadiene/styrene ratio (by weight) = 31/69) | 79 cc |
| 2,4-Dichloro-6-hydroxy-s-triazine, sodium salt, 4% solution | 20.5 cc |
| Distilled water | 900.5 cc |

*$(n)C_6H_{13}OOCCH_2$
$\quad\quad |$
$(n)C_6H_{13}OOCCH—SO_3Na$
was included in the latex solution as an emulsification and dispersing agent in an amount of 0.4 wt % with respect to the solid fraction of the latex.

Coating liquids for second subbing layers (hereafter referred to as second coating liquids) were coated over the above-mentioned first subbing layer on both sides of the film in an amount of 8.5 cc/m$^2$. Then, the undercoated films were dried. The compositions used to form these second coating liquids are indicated below.

Second Coating Liquid-1

| | |
|---|---|
| Gelatin | 10 g |
| Polymer Latex solution of solid fraction 20% (average particle size 0.05 μm) | 30 cc |

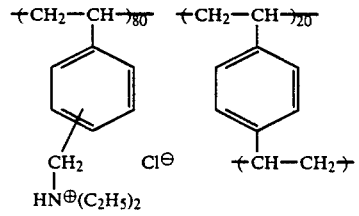

| | |
|---|---|
| Matting agent, poly(methylmethacrylate) of average particle size 2.5 μm | 0.3 g |

-continued

| | |
|---|---|
| 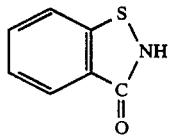 | 0.035 g |
| Dye II-8, 3% aqueous solution | 60 cc |

Water was added to the composition indicated above to produce a total volume of 1 liter.

Second Coating Liquid-2

The compound indicated below was added to the second coating liquid-1 to produce the second coating liquid-2:

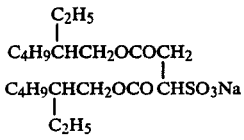

0.2 g

Second Coating Liquid-3

The compound indicated below was added to the second coating liquid-1;

| | |
|---|---|
| 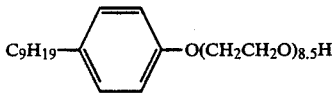 | 0.05 g |
| Second Coating Liquid-4 | |
| Same as Liquid 3 above | 0.1 g |
| Second Coating Liquid-5 | |
| Same as Liquid 3 above | 0.2 g |
| Second Coating Liquid-6 | |
| Same as Liquid 3 above | 0.5 g |
| Second Coating Liquid-7 | |
| The compound indicated below was added to the second coating liquid-1: $C_{12}H_{25}(CH_2CH_2O)_{10}H$ | 0.75 g |
| Second Coating Liquid-8 | |
| The compound indicated below was added to the second coating liquid-5: Methylcellulose ("Metrose SM15", made by the Shin-etsu Chemical Co.) degree of substitution 1.8 | 0.2 g |
| Second Coating Liquid-9 | |
| The compound indicated below was added to the second coating liquid-7: Methylcellulose ("Metrose SM15", made by the Shin-etsu Chemical Co.) degree of substitution 1.8 | 0.2 g |
| Second Coating Liquid-10 | |
| The compound indicated below was added to the second coating liquid-9: $C_{11}H_{23}CONHCH_2CH_2CHN^+(CH_3)_2COO^-$ | 0.2 g |

The subbing layer surface condition of the undercoated supports obtained in this way was evaluated by dying with brilliant blue. The assessment was made visually, the result being classified as O when there was no problem at all with undercoating unevenness, X when the unevenness was of such a degree as to be completely impractical, and between these extremes, three intermediate levels, namely OΔ, Δ and ΔX. The unevenness of the subbing considered here was ladder and streak unevenness, and those evaluated as being OΔ or better were of such a level as to be commercially useful. On the other hand, in the case of comet, the number of defective sites per square meter was counted. In this case the lower the number of defective sites, the better the result. The results of the evaluations are shown in Table 1.

TABLE 1

| Sample | Second Coating Liquid | Subbing Unevenness (ladder, stripe) | Comet (Number per square meter) |
|---|---|---|---|
| 1 | 1 (comparison) | X | 57 |
| 2 | 2 (Comparison) | X | 30 |
| 3 | 3 (This Invention) | Δ | 17 |
| 4 | 4 (This Invention) | OΔ | 11 |
| 5 | 5 (This Invention) | OΔ | 2 |
| 6 | 6 (This Invention) | O | 0 |
| 7 | 7 (This Invention) | O | 0 |
| 8 | 8 (This Invention) | O | 0 |
| 9 | 9 (This Invention) | O | 0 |
| 10 | 10 (This Invention) | O | 0 |

The effectiveness of the invention is clear from the results shown in Table 1.

EXAMPLE 2

First and second subbing layers were prepared as in Example 1. These subbing layers were applied to both surfaces of a polyethyleneterephthalate film. The second coating liquid-7 of Example 1 was used for the second subbiug layer. However, the dye used was modified as shown in Table 2 and Samples 11 to 22 were prepared so that the added amount of dye is $2.3\times10^{-3}$ mol per one liter of coating liquid.

With regard to each of these samples, the visible spectrum was measured and the optical density was determined as $D_1$ from the absorbed maximum wavelength.

Fixing rate was determined by the following equation:

$$\text{Fixing rate (\%)} = \frac{D_2}{D_1} \times 100$$

wherein $D_1$ is defined as above and $D_2$ is the optical density when sample is soaked in a pH 7.0 buffer solution for a period of ten minutes at 25° C.

Decoloration rate was determined by the following equation:

$$\text{Decoloration rate (\%)} = \frac{D_1 - D_3}{D_1} \times 100$$

wherein $D_1$ is defined as above and D3 is the optical density when sample is processed by an automatic developing machine consisting of the following steps.

| Automatic developing | | Dry to Dry 45 second processing | Specific surface area |
|---|---|---|---|
| Developing tank | 11.5 liter | 35° C. × 12.5 sec | 55 $cm^2$/liter |
| Fixing tank | 10 liter | 32° C. × 13.5 sec | 63 $cm^2$/liter |
| Rinsing tank | 7.5 liter | 31° C. × 7 sec | 84 $cm^2$/liter |
| Squeegee | | 40° C. 12 sec | |
| Drying | | 50° C. × 12 sec | |

Development Bath Concentrate

| | |
|---|---|
| Part A | |
| Potassium hydroxide | 1,107 g |
| Potassium sulfite | 1,680 g |
| Sodium hydrogencarbonate | 285 g |
| Boric acid | 38 g |
| Diethyleneglycol | 456 g |
| Ethylenediaminetetraacetate | 63.5 g |
| 5-methylbenzotriazol | 2.28 g |
| Hydroquinone | 1,140 g |
| Water to make | 9.50 liter |
| Part B | |
| Glacial acetic acid | 416.5 g |
| Triethyleneglycol | 456 g |
| 5-Nitroindazole | 9.5 g |
| 1-Phenyl-3-pyrazolidone | 106.4 g |
| Part C | |
| Glutraldehyde (50 wt/wt %) | 374.6 g |
| Meta-sodium bisulfite | 478.8 g |
| Water to make | 950 ml |
| Starter | |
| Glacial acetic acid | 270 g |
| Potassium bromide | 300 g |
| Water to make | 1.5 liter |

Preparation of Developing Bath 20 liters of water were added to about 50 liters of replenishing solution stock tank. Parts A, B, and C above were then added while mixing and dissolved, and finally water was added to produce 38 liters of the solution, yielding a developing solution replenishing solution (pH 10.30).

The above starter solution was added to this developing replenishing solution in an amount of 20 ml per liter, and the solution was used to fill an automatic developing machine development processing tank (pH 10.15). For each processed sample, 45 ml of the developing solution replenishing solution per film sheet (10 inch x 12 inch) was replenished.

Fixing Bath Concentrate (for 38 liters)

| | |
|---|---|
| Part A | |
| Thioammonium sulfate (70 wt/vol %) | 7,600 ml |
| Ethylenediaminetetraacetate | 0.76 g |

-continued

| | |
|---|---|
| disodium dihydrate | |
| Sodium sulfite | 570 g |
| Boric acid | 380 g |
| Sodium hydroxide | 245.6 g |
| Glacial acetic acid | 570 g |
| Water to make | 9.50 liter |
| Part B | |
| Ammonium sulfate | 380 g |
| Sulfuric acid (36 N) | 148.2 g |
| Water to make | 1,900 ml |

Preparation of Fixing Bath 20 liters of water were added to about 50 liters or replenishing solution stock tank. Parts A and B above were then added while mixing and dissolved, and finally water was added to produce 38 liters of the solution, yielding a fixing solution repenishing solution.

This fixer replenishing solution was used to fill a automatic developing machine fixing processing tank (pH 4.25). For each processed sample, 60 ml of the developing solution replenishing solution per film sheet (10 inch x 12 inch) was replenished.

The results are shown in Table 2.

TABLE 2

| Sample | Dye | Fixing rate | Decoloration rate |
|---|---|---|---|
| | | (%) | (%) |
| 11 | A (comparative) | 45 | 91 |
| 12 | B (comparative) | 82 | 60 |
| 13 | C (comparative) | 91 | 51 |
| 14 | D (comparative) | 99 | 18 |
| 15 | E (comparative) | 88 | 89 |
| 16 | F (comparative) | 98 | 74 |
| 17 | II-1 | 98 | 83 |
| 18 | II-8 | 100 | 89 |
| 19 | II-11 | 98 | 85 |
| 20 | II-25 | 100 | 88 |
| 21 | II-29 | 100 | 89 |
| 22 | II-43 | 99 | 90 |

The remarkable and unexpected effectiveness of this invention can be concluded from the results shown in Table 2.

The comparative dyes A through F are listed below:

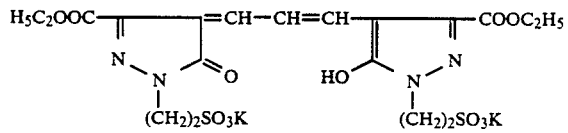

A

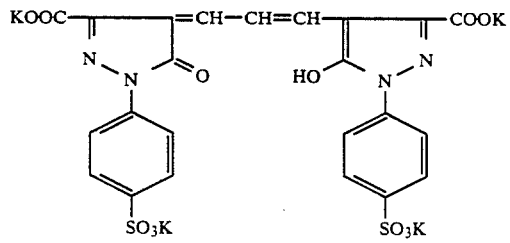

B

-continued

C

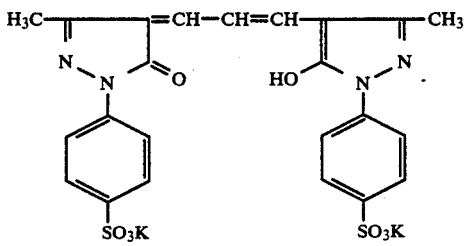

D

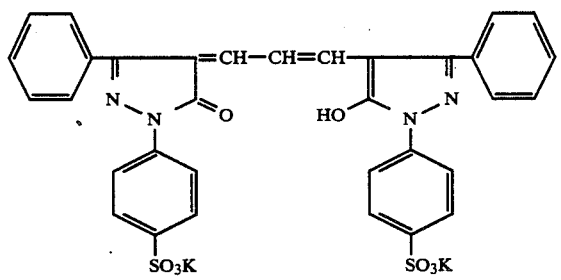

E

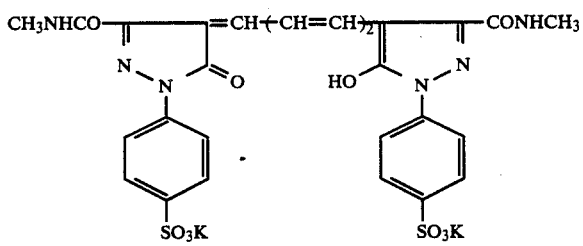

F

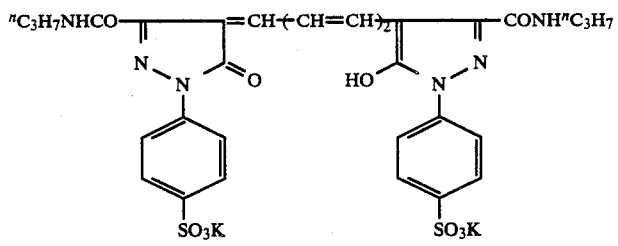

EXAMPLE 3

An evaluation of the decoloration rate of Samples 11 through 22 of Example 2 was conducted using an automatic developing machine process as described below, with the decoloration rate for all showing some % improvement with the degree of the improvement backing the results of this invention as in Example 2.

| | |
|---|---|
| Developing Bath Concentrate | |
| Potassium hydroxide | 56.6 g |
| Sodium sulfite | 200 g |
| Diethylenetriaminepentaacetate | 6.7 g |
| Potassium carbonate | 16.7 g |
| Boric acid | 10 g |
| Hydroquinone | 83.3 g |
| Diethyleneglycol | 40 g |
| 4-hydroxymethyl-4-methyl-1-phenyl-3-pyrazolidone | 11.0 g |
| 5-methylbenzotriazol | 2 g |
| Water to make | 1 liter |
| | (pH adjusted to 10.60) |
| Fixing Bath Concentrate | |
| Ammonium thiosulfate | 560 g |
| Sodium sulfite | 60 g |
| Ethylenediaminetetraacetate disodium dihydrate | 0.10 g |

-continued

| | |
|---|---|
| Sodium hydroxide | 24 g |
| Water to make | 1 liter |
| | (pH adjusted to 5.10 using acetic acid) |

| Automatic Processing | Processing Time and Temperature |
|---|---|
| Developing tank (6.5 liter) | 35° C. 12.5 sec |
| Fixing tank (6.5 liter) | 35° C. 10 sec |
| Rinsing tank (6.5 liter) | 20° C. 7.5 sec |
| Drying 50° C. | |
| Dry to dry processing time | 48 seconds |

At the start of the developing process, each tank was filled with processing solution as listed below:

Developing tank: 333 ml of the developing bath concentrate, 667 ml of water, and 10 ml of starter containing 2 g of potassium bromide and 1.8 g of acetic acid, with a pH of 10.15.

Fixing tank: 250 ml of the fixing bath concentrate and 750 ml of water

Running water was used as the rinse; its temperature was 15.5° C.

EXAMPLE 4

A blue transparent support consisting of polyethyleneterephthalate having a thickness of 175 μm which had been coated with a first subbing layer was prepared in the same way as in Example 1. Liquids (A) and (B) indicated below were separately prepared and than the two liquids were mixed together to provide a coating liquid for a second subbing layer.

Liquid (A)

| | |
|---|---|
| Gelatin | 8 g |
| Polymer latex solution (shown below), (solid fraction 20%, average particle size 0.05 μm) | 31 cc |

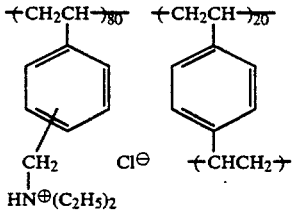

Dye II-8: 63 cc

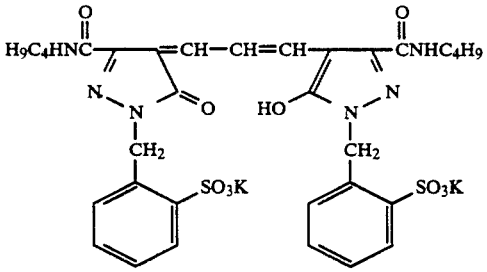

as a 3% solution 20 cc

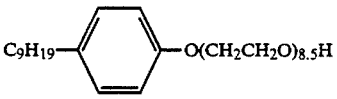

as a 1% solution

| | |
|---|---|
| Methylcellulose ("Metrose SM15", made by the Shin-etsu Chemical Co.) | 0.2 g |
| Water | 567 cc |

Liquid (B)

| | |
|---|---|
| Gelatin | 2 g |
| Matting agent, Poly(methyl methacrylate), (average particle size 2.5 μm) | 0.3 g |

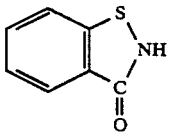

3.5% solution 1 cc

Water 308 cc

The mixture of Liquids (A) and (B) was coated on both sides in an amount of 8.5 cc/m$^2$ per side and both sides were dried.

Preparation of the Emulsion Layer Coating Liquid

Five grams of potassium bromide, 0.05 gram of potassium iodide, 30 grams of gelatin and 2.5 cc of a 5% aqueous solution of the thioether $HO(CH_2)_2S(CH_2)_2S(CH)_2OH$ were added to 1 liter of water, and the solution obtained was maintained at a temperature of 75° C. Next, an aqueous solution of 8.33 grams of silver nitrate and an aqueous solution which contained (i) 5.94 grams of potassium bromide and (ii) 0.726 gram of potassium iodide were added to the stirred solution over a period of 45 seconds using the double jet method. Then, after adding 2.5 grams of potassium bromide, 50 cc of an aqueous solution which contained 8.33 grams of silver nitrate was added over a period of 7 minutes 30 seconds, the addition being made in such a way that the flow rate at the end of the addition was double that at the start of the addition.

Next, 475 cc of an aqueous solution of 153.34 grams of silver nitrate and a 20 wt% aqueous solution of potassium bromide were added over a period of 25 minutes using the controlled double jet method while maintaining the potential at pAg 8.1. The flow rate at this time was accelerated so that the flow rate at the end of the addition was eight times that at the start of the addition. After the addition had been completed, 15 cc of a potassium thiocyanate solution (2N) were added. Further, a 50 cc of 1% aqueous solution of potassium iodide was added over a period of 30 seconds. The temperature was subsequently reduced to 35° C. and, after removing the soluble salts using the sedimentation (flocculation) method, the temperature was raised again to 40° C. whereupon 68 grams of gelatin, 2 grams of phenol and 7.5 grams of trimethylolpropane were added and the pH was adjusted to 6.40 with caustic soda and the pAg was adjusted to 8.45 with potassium bromide.

The temperature was then raised to 56° C. and 735 mg of a sensitizing dye, the structure of which is indicated below, were added. After 10 minutes, 8.2 mg of sodium thiosulfate pentahydrate, 163 mg of potassium thiocyanate and 5.4 mg of chloroauric acid were added and the mixture was cooled rapidly and set after 5 minutes. The emulsion thus obtained was such that grains which had an aspect ratio of at least 3 accounted for 93% of the total projected area of all the grains, and the average projected area diameter of the grains (which were all of aspect ratio of at least 2) was 0.83 μm, standard deviation 18.5%. The average thickness of the grains was 0.161 μm and the average aspect ratio was 5.16.

Sensitizing Dye

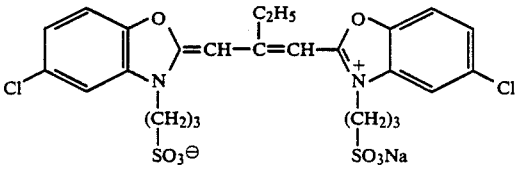

The chemicals indicated below were added to this emulsion in amounts indicated per mol of silver halide to form a coating liquid.

| | |
|---|---|
| 4-Hydroxy-6-methyl-1,3,3a,7-tetraazaindene | 1.94 g |
| 2,6-Bis(hydroxyamino)-4-diethylamino-1,3,5-triazine | 80 mg |
| Poly(sodium acrylate) (average molecular weight 41,000) | 4.0 g |

-continued

| | |
|---|---|
| 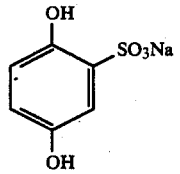 | 9.7 g |
| Copolymer plasticizer of Ethyl acrylate/acrylic acid = 95/5 (by mol) | 20.0 g |

The emulsion layer coating liquid thus obtained was coated onto both sides of the aforementioned coated support along with a surface protective layer liquid using a simultaneous extrusion system. At this time, the coated weights of the emulsion layer and the surface protective layer per surface were as indicated below:

| | |
|---|---|
| Emulsion Layer: | |
| Coated silver weight | 1.9 g/m$^2$ |
| Coated gelatin weight | 1.5 g/m$^2$ |
| Surface Protective Layer: | |
| Gelatin | 0.81 g/m$^2$ |
| Dextran (average molecular weight 39,000) | 0.81 g/m$^2$ |
| Matting agent Poly(methyl methacrylate)/methacrylic acid = 9/1 copolymer, average particle size 3.5 μm) | 0.06 g/m$^2$ |
| $C_8H_{17}$—$C_6H_4$—$O(CH_2CH_2O)_{10}(CH_2CH(OH)CH_2O)_3H$ | 60 mg/m$^2$ |
| $C_8H_{17}$—$C_6H_4$—$O(CH_2CH_2O)_2CH_2CH_2SO_3Na$ | 20 mg/m$^2$ |
| $C_8F_{17}SO_2N(C_3H_7)(CH_2CH_2O)_4(CH_2)_4SO_3Na$ | 2 mg/m$^2$ |
| $C_8F_{17}SO_2N(C_3H_7)(CH_2CH_2O)_{15}H$ | 5 mg/m$^2$ |
| Poly(sodium acrylate) (average molecular weight 41,000) | 70 mg/m$^2$ |

1,2-Bis(sulfonylacetamido)ethane was coated at a rate of 127 mg/m$^2$ per side as a film hardening agent, and Photographic material 23 of this invention was thereby obtained.

Preparation of Comparative Photographic Material 24

The polymer latex and dye used in coating layer liquid (A) of photographic material 23 of the present invention were changed to those indicated below, respectively.

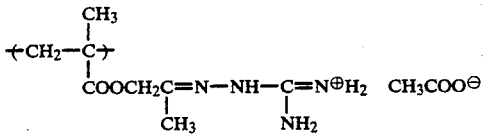

20% solution 47 cc

-continued

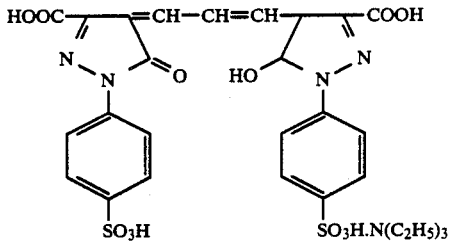

3% solution 63 cc

The photographic material 24 was then prepared in the same way as photographic material 23.

Evaluation of Photographic Performance

Photographic materials 23 and 24 were adhered on both sides with Fuji Photo Film Co., Ltd. GRENEX orthoscreen G-4 using a cassette, and then they were subjected to X-ray sensitometry. Exposure control was achieved by varying the distance between the x-ray tube and the cassette. After exposure, the materials were processed in an automatic developing machine using the development and fixing baths indicated below. The sensitivity has indicated as a relative value in each case, taking that of the photographic material 23 to be 100.

| | |
|---|---|
| Development Bath Concentrate | |
| Potassium hydroxide | 56.6 g |
| Sodium sulfite | 200 g |
| Diethylenetriamine penta-acetic acid | 6.7 g |
| Potassium carbonate | 16.7 g |
| Boric acid | 10 g |
| Hydroquinone | 83.3 g |
| Diethyleneglycol | 40 g |
| 4-Hydroxymethyl-4-methyl-1-phenyl-3-pyrazolidone | 11.0 g |
| 5-Methylbenzotriazole | 2 g |
| Water to make up to | 1 liter (pH adjusted to 10.60) |
| Fixing Bath Concentrate | |
| Ammonium thiosulfate | 560 g |
| Sodium sulfite | 60 g |
| Ethylenediamine tetra-acetic acid, disodium salt.dihydrate | 0.10 g |
| Sodium hydroxide | 24 g |
| Water to make up to | 1 liter (pH adjusted to 5.10 with acetic acid) |

| Automatic Developing Machine | | Processing |
|---|---|---|
| Development Tank | 6.5 liters | 35° C. × 12.5 sec. |
| Fixing Tank | 6.5 liters | 35° C. × 10 sec. |
| Water Wash Tank | 65. liters | 20° C. × 7.5 sec. |
| Drying | | 50° C. |
| Dry to dry processing time | | 48 seconds |

At the start of development processing, the processing baths were supplied to each tank as indicated below.

Development Tank:

333 ml of the above-mentioned development bath concentrates, 667 ml of water, and 10 ml of a starter which contained 2 grams of potassium bromide and 1.8 grams of acetic acid, the pH being set at 10.15. Fixing Tank:

The above mentioned fixing bath concentrate (250 ml) and 750 ml of water.

Measurement of Sharpness (MTF)

The MTF was measured using the aforementioned combination of G-4 screen and the automatic development processor treatment. Measurements were made with a 30 μm×500 μm aperture and the evaluation was made in a part of optical density 1.0 using an MTF value of spatial frequency 1.0 cycle/mm.

Measurement of Residual Coloration

Unexposed film was passed through the aforementioned development processing, and the green transmission density was measured through a Macbeth Status A filter. Then, the green transmission density of a blue dyed polyethyleneterephthalate support which had not been undercoated was measured; the net value obtained by subtracting this value was used to evaluate the residual color density.

The results obtained are summarized in Table 3.

TABLE 3

| Photographic Material | Relative Sensitivity | MTF | Residual Color |
|---|---|---|---|
| 23 (This Invention) | 100 | 0.86 | 0.07 |
| 24 (Comparison) | 90 | 0.84 | 0.13 |

It is clear from Table 3 that the present invention provides a high degree of sharpness even in ultra-rapid processing with a dry to dry time of 48 seconds, and that it provides excellent results in connection with residual coloration and drying properties. Moreover, adhesion failure occurred with comparative photographic material 24 with some peeling between the emulsion layer and the support at the processing.

While the invention has been described in detail and with reference to specific embodiments thereof, it will be apparent to one skilled in the art that various changes and modifications can be made therein without departing from the spirit and scope thereof.

What is claimed is:

1. A silver halide photographic material which comprises a support having provided thereon at least one light-sensitive silver halide emulsion layer and at least one subbing layer, wherein said at least one subbing layer comprises:

(a) a binder;

(b) a polymer represented by formula (I):

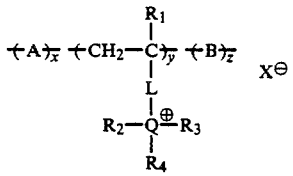

(I)

wherein A represents an ethylenic unsaturated monomer unit, $R_1$ represents a hydrogen atom or a lower alkyl group having from 1 to 6 carbon atoms, L represents a divalent group having from 1 to 12 carbon atoms, $R_2$, $R_3$ and $R_4$, which may be the same or different, each represents an alkyl group, an aralkyl group or a hydrogen atom, Q represents nitrogen or phosphorous, provided that $R_2$, $R_3$ and $R_4$ may be linked together to form, together with Q, a cyclic structure, $X^{\ominus}$ represents an anion other than iodine ion, B represents a structural unit in which copolymerizable monomers having at least two ethylenic unsaturated groups have been copolymerized, x is selected to constitute from 0 to 90 mol%, y is selected to constitute from 10 to 100 mol%, and z is selected to constitute from 0 to 90 mol%;

(c) a dye represented by formula (II);

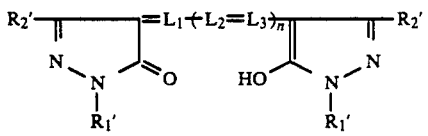

(II)

wherein $R_1'$ represents an aryl, alkyl, aralkyl, or heterocyclic group substituted with at least one carboxylic acid or sulfonic acid group, $R_2'$ represents a group $—CONR_3'R_4'$ or a group $—NR_3'COR_4'$ wherein $R_3'$ represents a hydrogen atom or an alkyl group, and $R_4'$ represents an alkyl group having a hydrophobic substituent constant $\pi$ within a range from 1.60 to 3.9, $L_1$ $L_2$, and $L_3$ each represents a methine group, and $\eta$ represents 0, 1 or 2; and (d) a nonionic surface active agent.

2. A silver halide photographic material as in claim 1, wherein said binder is gelatin.

3. A silver halide photographic material as in claim 1, wherein said polymer represented by formula (I) is present in said subbing layer in an amount of from 5 to 300 mg/m².

4. A silver halide photographic material as in claim 3, wherein said polymer represented by formula (I) is present in said subbing layer in an amount of from 10 to 100 mg/m².

5. A silver halide photographic material as in claim 1, wherein said dye represented by formula (II) is present in said subbing layer in an amount of from 0.5 to 200 mg/m².

6. A silver halide photographic material as in claim 5, wherein said dye represented by formula (II) is present in said subbing layer in an amount of from 2 to 50 mg/m².

7. A silver halide photographic material as in claim 1, comprising two subbing layers, the second subbing layer being coated on the first subbing layer.

8. A silver halide photographic material as in claim 7, wherein the first subbing layer contains a butadiene type polymer latex or a vinylidene chloride type polymer and the second subbing layer contains a latex form of said polymer of formula (I), said dye of formula (II) and said nonionic surfactant.

9. A silver halide photographic material as in claim 7, wherein the thickness of the first subbing layer is 0.05 to 1.0 μm and the thickness of the second subbing layer is 0.05 to 0.3 μm.

10. A silver halide photographic material as in claim 9, wherein the thickness of the first subbing layer is 0.1 to 0.5 μm and the thickness of the second subbing layer is 0.08 to 0.2 μm.

* * * * *